US007080535B2

(12) United States Patent
Kruger et al.

(10) Patent No.: US 7,080,535 B2
(45) Date of Patent: Jul. 25, 2006

(54) SPRING-LOADED PART EXTRACTORS FOR HEATED FORMING TOOLS

(75) Inventors: Gary A. Kruger, Troy, MI (US); James G. Schroth, Troy, MI (US); Richard Harry Hammar, Utica, MI (US)

(73) Assignee: General Motors Corporation, Detroit, MI (US)

( * ) Notice: Subject to any disclaimer, the term of this patent is extended or adjusted under 35 U.S.C. 154(b) by 276 days.

(21) Appl. No.: 10/827,721

(22) Filed: Apr. 20, 2004

(65) Prior Publication Data

US 2005/0229664 A1 Oct. 20, 2005

(51) Int. Cl.
*B21D 26/02* (2006.01)

(52) U.S. Cl. ..... 72/57; 72/60; 72/340; 29/421.1

(58) Field of Classification Search ..... 72/57, 72/58, 60, 340, 352; 29/421.1
See application file for complete search history.

(56) References Cited

U.S. PATENT DOCUMENTS

| | | | | |
|---|---|---|---|---|
| 5,214,949 | A * | 6/1993 | Cadwell | 72/60 |
| 6,253,588 | B1 * | 7/2001 | Rashid et al. | 72/57 |
| 6,615,631 | B1 * | 9/2003 | Kleber et al. | 72/60 |
| 6,837,087 | B1 * | 1/2005 | Kleber et al. | 72/60 |
| 6,843,088 | B1 * | 1/2005 | Kruger et al. | 72/57 |

* cited by examiner

*Primary Examiner*—David Jones
(74) *Attorney, Agent, or Firm*—Kathryn A. Marra

(57) ABSTRACT

A hot blow-forming apparatus includes opposed and complementary forming tools adapted for hot blow forming a surface of a heated sheet-metal workpiece against a forming surface of one of the tools. The tools are also adapted to close upon and grip a peripheral edge of the workpiece and perform work on a central portion of the workpiece to produce a formed panel. The tools incorporate an improved extraction apparatus, which includes a plurality of opposed and complementary spring-loaded extractor pads. Opposed extractor pads are spring-loaded to different levels so as to apply spring-load differentials therebetween and thereby apply different extraction forces in different locations of the resultant formed panel for distortion-free removal of the formed panel from the working surfaces of the tooling.

12 Claims, 7 Drawing Sheets

SPRING-LOADED PART EXTRACTORS FOR HEATED FORMING TOOLS

TECHNICAL FIELD

The present invention generally pertains to hot blow-forming of metal alloy sheet blanks into articles of complex curvature such as automotive body panels. More specifically, this invention pertains to hot blow-forming tooling having spring-loaded extractor pads for distortion-free removal of a formed, heat softened, sheet-metal panel.

BACKGROUND OF THE INVENTION

Sheet-metal articles can be made by hot blow-forming processes that use complementary forming tools in a press under the pressure of a working gas to stretch-form a preheated sheet-metal blank against heated forming surfaces on the forming tools. Such processes are particularly applicable to forming sheet-metal into products of complex three-dimensional curvature. For example, superplastic-forming (SPF) and quick-plastic-forming (QPF) processes are increasingly being used to produce high quality sheet-metal products such as automotive body panels. One such process is disclosed in U.S. Pat. No. 6,253,588, entitled "Quick Plastic Forming of Aluminum Alloy Sheet-metal" to Rashid et al., which is assigned to the assignee hereof and which is incorporated by reference herein.

While such SPF and QPF processes and equipment generate improved parts, production efficiency has at times been diminished because of the time required to effectively remove parts from forming tools. At elevated forming temperatures on the order of 900° F., a formed sheet-metal panel tends to "stick" to a hot forming surface or seal bead of the forming tool. Attempts to mechanically pry a heat-softened panel from a hot forming tool inevitably result in undesirable distortion of the panel. Various other prior art approaches for extracting a heat-softened panel from a hot forming tool suffer from one or more of the following problems: puncture of the panel, non-uniform or erratic extraction and resulting distortion of the panel, complex extraction equipment requiring auxiliary drives and control mechanisms, and excessive lubricant build-up on the forming tools. Thus, it is an object of this invention to provide an improved apparatus for removing a heat-softened formed panel from hot blow-forming tooling that does not suffer from the foregoing disadvantages of prior art approaches.

SUMMARY OF THE INVENTION

The present invention provides an improved extraction apparatus used in a process of hot blow-forming a preheated sheet-metal workpiece into a formed panel, wherein the apparatus is adapted for distortion-free removal of the formed panel from working surfaces of forming tools. The extraction apparatus includes adjustable, spring-loaded extractor mechanisms built into the forming tools. The extractor mechanisms are adjustable by selecting different sized shims to pre-load the extractor mechanisms to different levels to strategically minimize distortion of a finished part upon removal of the part from the forming tools. The apparatus thereby eliminates conventional extraction problems including use of external drive mechanisms and controls or manual extraction techniques that typically yield panel distortion.

In general, the hot blow-forming tooling includes opposed and complementary tools that are adapted for hot blow forming a first or second surface of the heated sheet-metal workpiece against a forming surface of one of the tools. The tools are also adapted to close upon and grip a peripheral, circumferential edge of the workpiece and perform work on a central portion of the workpiece that is circumscribed by the peripheral edge. The tools incorporate the improved extraction apparatus, which includes a plurality of opposed and complementary spring-loaded extractor pads. The opposed and complementary extractor pads are spring-loaded in such a manner so as to apply different extraction forces in various locations on the resultant formed panel.

More specifically, a first forming tool includes a first forming surface and a first binder surface surrounding the first forming surface for sealingly engaging the first surface of the workpiece at the peripheral edge thereof. The first forming tool includes a first plurality of spring-loaded extractor mechanisms that partially define the first binder surface and that circumscribe the first forming surface. A second forming tool is positioned opposite of and complementary with respect to the first forming tool. The second forming tool includes a second forming surface and a second binder surface circumscribing the second forming surface for sealingly engaging the second surface of the workpiece at the peripheral edge thereof. The second forming tool includes a second plurality of spring-loaded extractor mechanisms that partially define the second binder surface and that are positioned outboard of the second forming surface. The second plurality of spring-loaded extractor mechanisms are substantially opposed to and complementary with the first plurality of spring-loaded extractor mechanisms, so as to define a plurality of matched and opposed pairs of extractor mechanisms.

The spring-loaded extractor mechanisms include extractor pads positioned within extractor pockets in the forming tools. The extractor pads are movably fastened within the extractor pockets by shoulder bolts, wherein the extractor pads are movable within limits established by the bottom of the extractor pockets and caps on the shoulder bolts. The extractor pads are biased away from the tools by compression springs and spring backup details that are located in spring bores in the extractor pockets. The springs are pre-loaded by shims of various predetermined sizes to yield predetermined spring-loads. To pre-load the springs, first, wedge tools are inserted into access pockets in the sides of the tools to apply lift to the spring compression assemblies and the springs. Second, the shims are slid into the access pocket between forks of respective wedge tools. Third, the wedge tools are retracted out of the access pockets to permit the springs and spring compression assemblies to locate in their pre-load position against the shims.

In accordance with a preferred embodiment of the present invention, at least one of the second plurality of spring-loaded extractor mechanisms has a different spring pre-load from that of an opposed and complementary spring-loaded extractor mechanism of the first plurality of spring-loaded extractor mechanisms, thereby establishing a spring-load differential therebetween. The spring-load differential is achieved by use of differently sized shims in opposed extractor mechanisms to pre-load compression springs to different levels of spring-load. As a result, portions of the workpiece between the opposed extractor mechanisms are relatively biased against one or the other of the opposed spring-loaded extractor mechanisms.

Using the improved extraction apparatus of the present invention, various combinations of spring pre-loads can be used to extract the finished panel from the tools. For example, one embodiment of the present invention is adapted for progressively peeling the finished panel away from a forming tool at a corner position along one side of the forming tool, while the finished panel is maintained biased against the forming tool at an opposite corner position and a center position along the one side of the forming tool. Another embodiment of the present invention is adapted for uniformly separating the entire panel away from one of the opposed forming tools, and subsequently separating the panel away from the other of the opposed forming tools. A further embodiment of the present invention is adapted for symmetrically peeling the finished panel away from a forming tool at a center position along one side of the forming tool, while the finished panel is maintained biased against the forming tool at laterally opposite corner positions on either side of the center position along the one side of the forming tool. Thereafter the panel is separated away from the opposed and complementary forming tool at the laterally opposite corner positions.

The advantages of the improved extraction apparatus of the present invention are numerous. The extraction apparatus enables non-uniform, progressive extraction of a hot workpiece for smoother, more reliable extraction motion. Also, the present invention does not involve active, complex drive mechanisms and controls. Rather, the present invention involves passive and relatively maintenance-free extraction devices. The apparatus of the present invention also does not puncture the heat-softened panel or lead to excessive lubricant build-up on the forming tools. Other objects and advantages of the invention will become apparent from a detailed description of preferred embodiments of the invention which follow.

DESCRIPTION OF THE PREFERRED EMBODIMENT

In general, the present invention provides an improved extraction apparatus for use in a process of hot blow-forming a heat-softened sheet-metal workpiece into a formed panel, wherein the apparatus is adapted to minimize distortion of the formed panel upon removal of the formed panel from working surfaces of forming tools. The extraction apparatus includes adjustable, spring-loaded extractor mechanisms built into the forming tools. The apparatus thereby eliminates conventional extraction problems including use of complex drive mechanisms and controls or manual extraction techniques that typically yield panel distortion, damage, scrap, and the like.

Figure 1:
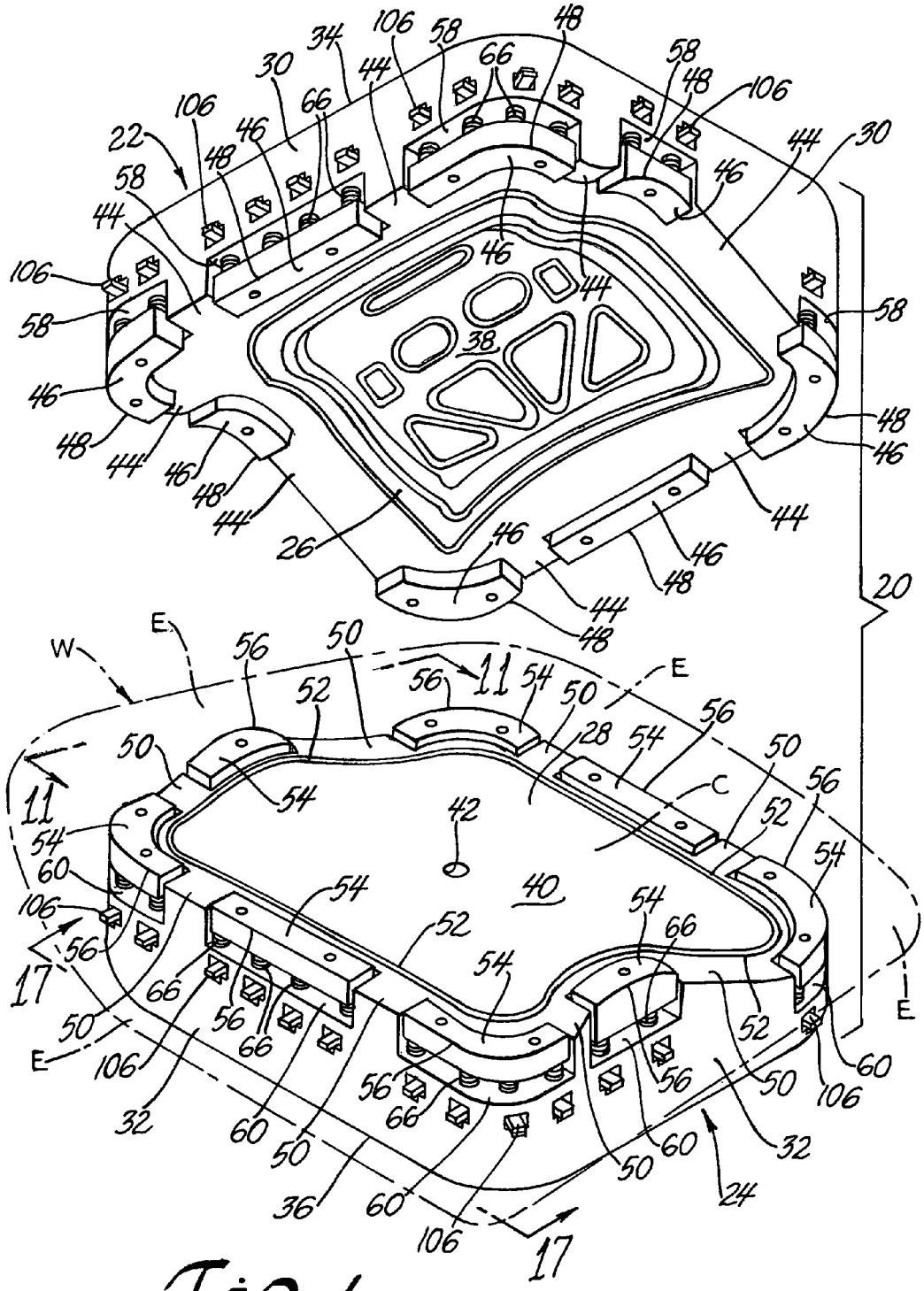
FIG. 1 illustrates a complementary set of forming tools for a hot blow forming process, wherein an upper forming tool includes a forming tool surface and an upper set of spring-loaded extractors that are complementary to a lower set of spring-loaded extractors of a lower forming tool.

Referring specifically now to the Figures, there is illustrated in FIG. 1 a perspective view of a complementary set 20 of forming tools that is used in a hot blow forming process to blow form a substantially two-dimensional flat metal sheet or workpiece W (shown in phantom lines) into a three dimensional finished part or panel (not shown). The set 20 of forming tools include an upper forming tool 22 and an opposed and complementary lower forming tool 24, each having a working surface 26, 28, side walls 30, 32, and rear locating surfaces 34, 36. The set 20 of forming tools is adapted for use between a press bed and a press ram of a press (not shown). As such, the rear locating surface 34 of the upper forming tool 22 locates against a press ram or an intermediate platen of the press (not shown), while the rear locating surface 36 of the lower forming tool 24 locates against a press bed or an intermediate platen of the press (not shown).

The working surfaces 26, 28 of the forming tools 22, 24 include various surfaces or features for working the sheet-metal workpiece W. The working surface 26 of the upper forming tool 22 includes a forming surface 38 having three dimensional surface details that define the shape of the finished panel after the workpiece W is formed against the forming surface 38. Functionally complementing the forming surface 38 of the upper forming tool 22, the working surface 28 of the lower forming tool 24 includes a pressure chamber surface 40 having a gas port 42 therein for supplying working gas for hot blow forming. As defined herein, the term forming surface encompasses a non part-defining feature or surface such as a pressure chamber or any surface thereof.

The working surfaces 26, 28 of the forming tools 22, 24 also include surfaces or features for holding the workpiece or finished product. The working surface 26 of the upper forming tool 22 includes a binder surface 44 that is radially outboard of the forming surface 38 and that includes individual binder surfaces 46 on an upper plurality of spring-loaded extractor pads 48. The extractor pads 48 are located in corner positions and in center positions along the sides 30 of the form tool 22. Structurally complementing the binder surface 44 of the upper forming tool 22, the working surface 28 of the lower forming tool 24 also includes a binder surface 50 just radially outboard of the pressure chamber surface 40. The binder surface 50 includes a raised seal bead 52 and individual binder surfaces 54 on a lower plurality of spring-loaded extractor pads 56. The extractor pads 56 are located in corner positions and in center positions along the sides 32 of the form tool 24. Accordingly, the opposed and complementary extractor pads 48, 56 are provided in matched sets that generally follow the contour of the seal bead 52. The binder surfaces 44, 50 are provided to close upon and grip a peripheral edge E of the workpiece W and finished panel (not shown). Those of ordinary skill in the art will recognize that the terminology, peripheral edge, includes not only the actual lateral outer periphery of the workpiece or finished panel but also marginal portions on either side of the workpiece or finished panel located inboard of the actual edge. As defined herein, the term extract is synonymous with the term eject.

In operation, the pre-heated metal sheet is placed between the upper and lower forming tools 22, 24 within the press (not shown). The press ram (not shown) drives the upper forming tool 22 down against the lower forming tool 24 until the workpiece W is trapped between the complementary binder surfaces 44, 50, at which point all of the spring-loaded extractor pads 48, 56 are fully displaced into their respective extractor pockets 58, 60. Then, working gas is introduced through the gas port 42 in the lower forming tool 24 such that gas pressure is trapped by the seal bead 52, a lower surface of the workpiece W, and the pressure chamber surface 40 of the lower forming tool 24. A central portion C of the workpiece W is thereby blown against the upper forming tool 22 such that an upper surface of the workpiece W is formed into close conforming relationship with the forming surface 38 of the upper forming tool 22 to create the finished panel (not shown). Thereafter, the forming tools 22, 24 are separated and the finished panel is automatically ejected or extracted away from the opposed working surfaces 26, 28 of the forming tools 22, 24, as will be discussed in detail further below with respect to FIGS. 11–19. Before that discussion, however, the structure and functioning of the extractor pads 48, 56 will be described in reference to FIGS. 2–10. As defined herein, the central portion C of the workpiece W refers to that portion of the workpiece W that is circumscribed by the seal bead 52 when the tools 22, 24 are closed together. Also, the peripheral edge E is defined as that portion of the workpiece W outboard of the central portion C. In other words, the peripheral edge E is a marginal portion of the workpiece between the outboard boundary of the central portion C and the laterally outer edge of the workpiece W.

Figure 2:
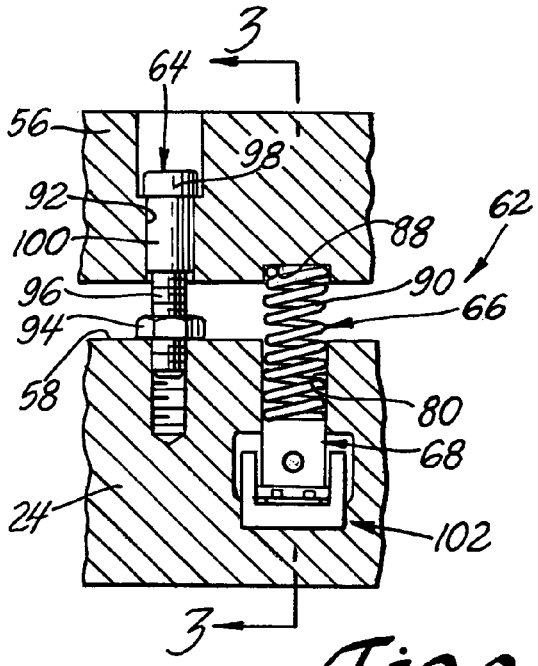
FIG. 2 illustrates a partial cross-sectional view through one of the spring-loaded extractors of the lower forming tool, wherein a wedge tool is being inserted into an access pocket of the lower forming tool to displace a spring and backup detail to enable insertion of a pre-load shim in the access pocket.
Figure 3:
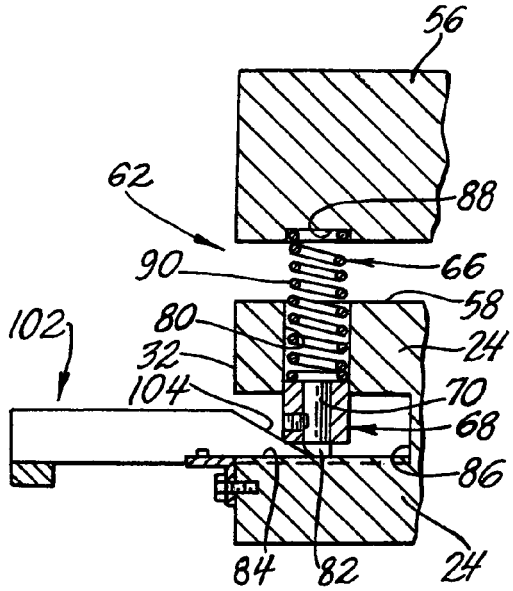
FIG. 3 illustrates a partial cross-sectional view of the spring-loaded extractor and wedge tool of FIG. 2, taken along line 3—3 thereof.

Referring now to FIGS. 2 and 3, there is shown an exemplary spring-loaded extractor mechanism 62 that is typical of all of the spring-loaded extractor mechanisms of both the upper and lower forming tools 22, 24 of the present invention and that includes a portion of the lower forming tool 24, a portion of one of the extractor pads 56, and extractor hardware therebetween. The extractor hardware includes a fastener such as a shoulder bolt 64 for fastening the extractor pad 56 to the forming tool 24, a spring 66 for biasing the extractor pad 56 away from the forming tool 24, and a spring backup assembly 68 to enable pre-loading of the spring 66. The backup assembly 68 is shown in exploded view in FIG. 9, wherein a T-shaped detail or shoe 70 is axially inserted into a hollow cylinder 72 and a set screw 74 is radially threaded into the hollow cylinder 72 for engaging a drill point 76 in a shank portion 78 of the shoe 70.

Referring again to FIGS. 2 and 3, the backup assembly 68 is installed into a spring bore 80 in the pocket surface 58 of the lower forming tool 24 until a radiused end 82 of the backup assembly 68 rests on a lower surface 84 of an access pocket 86 provided in the side wall 32 of the forming tool 24 and in communication with the spring bore 80. Note that the height of the backup assembly 68 is greater than the height of the access pocket 86 to maintain the backup assembly 68 in the spring bore 80. Then the spring 66 is placed into the spring bore 80 atop the backup assembly 68. The extractor pad 56 is inserted into the respective pocket 58 of the lower forming tool 24 such that a spring locator recess 88 accepts an upper end 90 of the spring 66. The shoulder bolt 64 is placed through a counterbored passage 92 in the extractor pad 56 and a lock nut 94 is threaded to a shank 96 of the shoulder bolt 64. The shank 96 is threaded into a surface of the extractor pocket 58 of the lower forming tool 24 and the lock nut 94 is thereafter tightenable against the surface of the pocket 58 for setting the operational height of the extractor pad 56 to a predetermined desired height. The operational height of the extractor pad 56 is constrained by 1) the maximum uncompressed height of the spring 66 and 2) the interference of the bottom of the counterbore with cap or head 98 of the shoulder bolt 64. A journalled shoulder portion 100 of the shoulder bolt 64 fits closely within the counterbored passage 92 for smooth, non-binding up and down motion of the extractor pad 56 relative to the lower forming tool 24. Preferably, at least two shoulder bolts 64 are used for each extractor pad 56.

Also shown in FIGS. 2 and 3 is a bifurcated wedge tool 102 that is shown being inserted into the access pocket 86 such that a taper 104 on the tool 102 engages the bottom of the shoe 70 of the backup assembly 68, such that the radiused portion 82 of the shoe 70 rides up the taper 104 to displace the backup assembly 68 and spring 66, as will be further discussed with reference to FIGS. 4 and 5 below. In other words, the spring backup assembly 68 is an intermediate device that permits the wedge tool 102 to axially displace the spring 66 without binding or damaging the spring 66.

Figure 4:
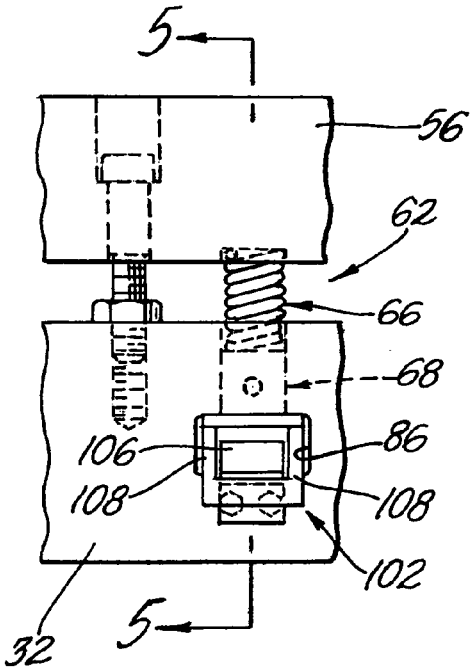
FIG. 4 illustrates a partial elevational view of the spring-loaded extractors of the lower forming tool, wherein a pre-load shim has been installed into the access pocket and located on an angle-iron support.
Figure 5:
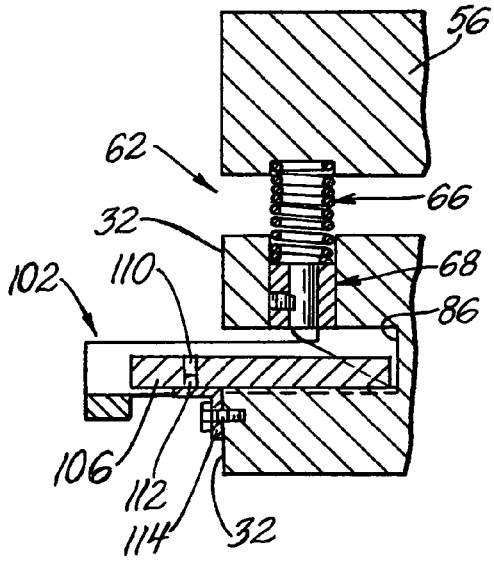
FIG. 5 illustrates a partial cross-sectional view of the spring-loaded extractor, wedge tool, and pre-load shim of FIG. 4, taken along line 5—5 thereof.
Figure 8:
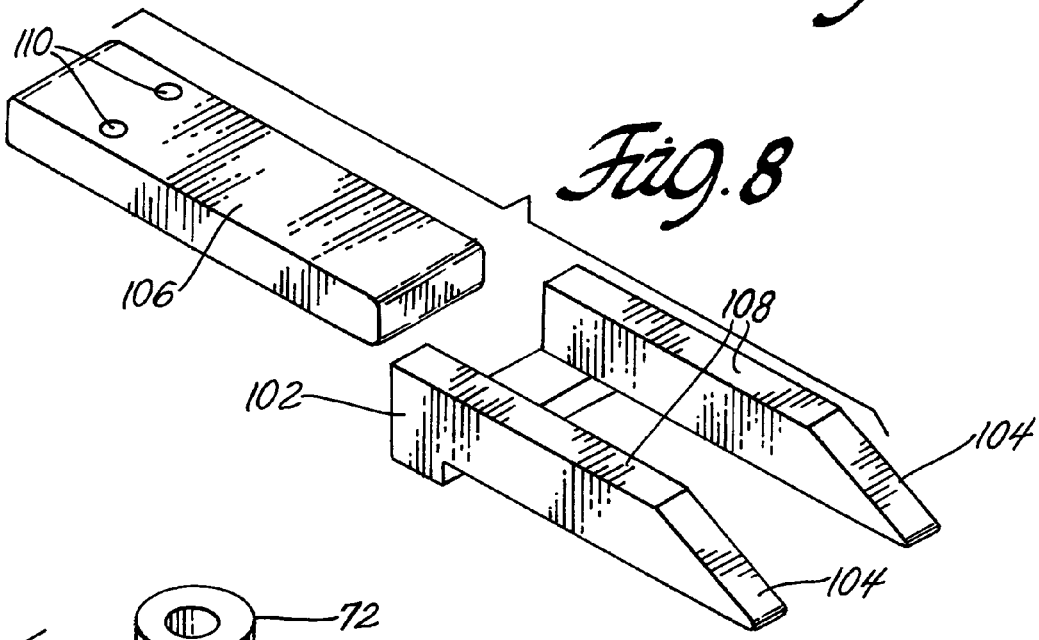
FIG. 8 illustrates a perspective view of the wedge tool and pre-load shim of FIGS. 4 and 5.
Figure 9:
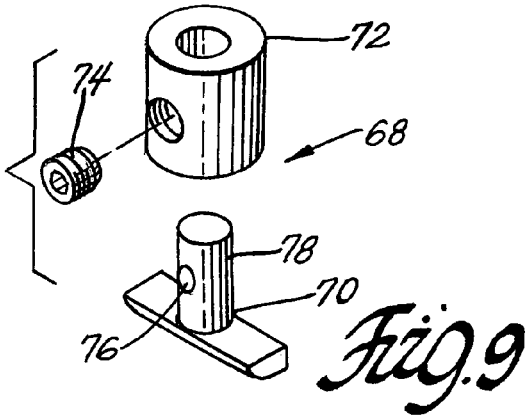
FIG. 9 illustrates an exploded perspective view of the backup detail of FIGS. 2 through 7.
Figure 10:
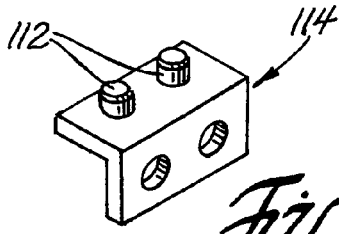
FIG. 10 illustrates a perspective view of the angle iron support of FIGS. 2 through 7.

FIGS. 4 and 5 illustrate the backup assembly 68 and spring 66 being displaced by the wedge tool 102 such that the spring 66 is nearly fully compressed. Thereafter, a spacer or shim 106 is inserted between forks 108 of the wedge tool 102 into the access pocket 86. The shim 106 and wedge tool 102 are collectively depicted in FIG. 8, which shows that the shim 106 is slidable between the forks 108 of the tool 102. FIG. 8 also shows the taper 104 of the tool and locating holes 110 in the shim 106. Referring again to FIGS. 4 and 5, the shim 106 is installed until the locator holes 110 in the shim 106 locate on locator pins 112 of an angle iron bracket 114 that is fastened to the side wall 32 of the lower forming tool 24. The bracket 114 is individually depicted in FIG. 10 showing the locator pins 112.

Figure 6:
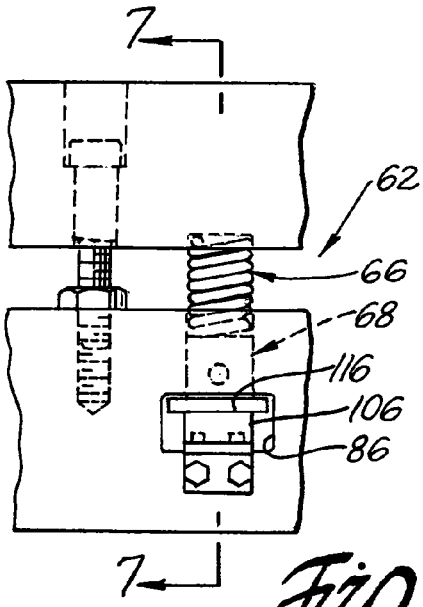
FIG. 6 illustrates a partial elevational view of the pre-load shim installed into the access pocket, wherein the backup detail is located against a top surface of the pre-load shim and whereby the pre-load shim pre-loads the spring so as to increase the spring-load thereof.
Figure 7:
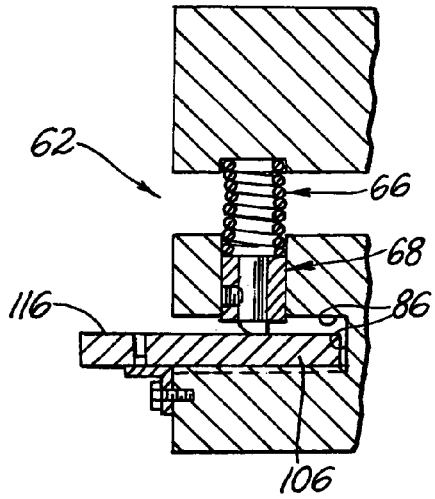
FIG. 7 illustrates a partial cross-sectional view of the spring-loaded extractor and pre-load shim of FIG. 6, taken along line 7—7 thereof.

Referring now to FIGS. 6 and 7, the tool (not shown) is then removed from the access pocket 86, thereby allowing the spring 66 to extend and force the backup assembly 68 against a top surface 116 of the shim 106. Accordingly, the spring 66 may be pre-loaded by the shim 106 in this manner to any predetermined desired spring pre-load. In other words, the pre-load on the spring 66 may be varied by supplying shims 106 of various heights or thicknesses.

The present invention assumes use of high temperature compression springs and not constant-force springs, which are used when a constant force must be applied by the spring regardless of the degree of displacement of the spring. Thus, the springs of the present invention comport with Hooke's Law which basically provides that the stored force of a compressed spring is proportional to the displacement of the spring and that a compressed spring will return to its rest length when a load on the spring is removed, so long as the elastic limit of the spring material has not been exceeded. As defined herein, spring pre-load refers to a predetermined load imposed on a spring, such as by displacing or compressing the spring to a predetermined height via a shim. The term spring-load is broader and refers to the stored force of a compressed spring that is substantially proportional to, or at least dependent on, the degree of displacement of the spring, whether the spring is in an uncompressed free state, pre-loaded with a shim, or the like.

Referring again to FIG. 1, the spring-loaded extractor mechanisms of FIGS. 2–7 are shown in the upper and lower forming tools 22, 24, as indicated by the shims 106. The foregoing description of the spring-load extractor mechanisms applies also to the upper forming tools 22, bearing in mind that the orientations are simply reversed. It is preferable that extractor pads 48, 56 are individually spring-loaded with two or more springs having similar or the same spring-loads and pre-loads so as to avoid any binding condition of the respective extractor pad 48, 56 due to non-uniform spring-loads. Among different extractor pads 48, 56 on one of the forming tools 22, 24 it may be desirable to use the same spring-loads and/or spring pre-loads to achieve a uniform simultaneous application of an ejection force on the finished panel to separate the panel from the forming tool. However, among different extractor pads 48, 56 on one or both of the forming tools 22, 24 it may also be desirable to use different levels of spring-loads and/or spring pre-loads, such as by using different shim heights. Such a configuration would permit sequential or progressive separation of the finished panel from the forming tool in different locations around the perimeter of the forming tool(s), so as to effectively peel the finished panel from the forming tool(s). These options will be described in greater detail below with respect to the different embodiments of FIGS. 11–19.

Figure 11:
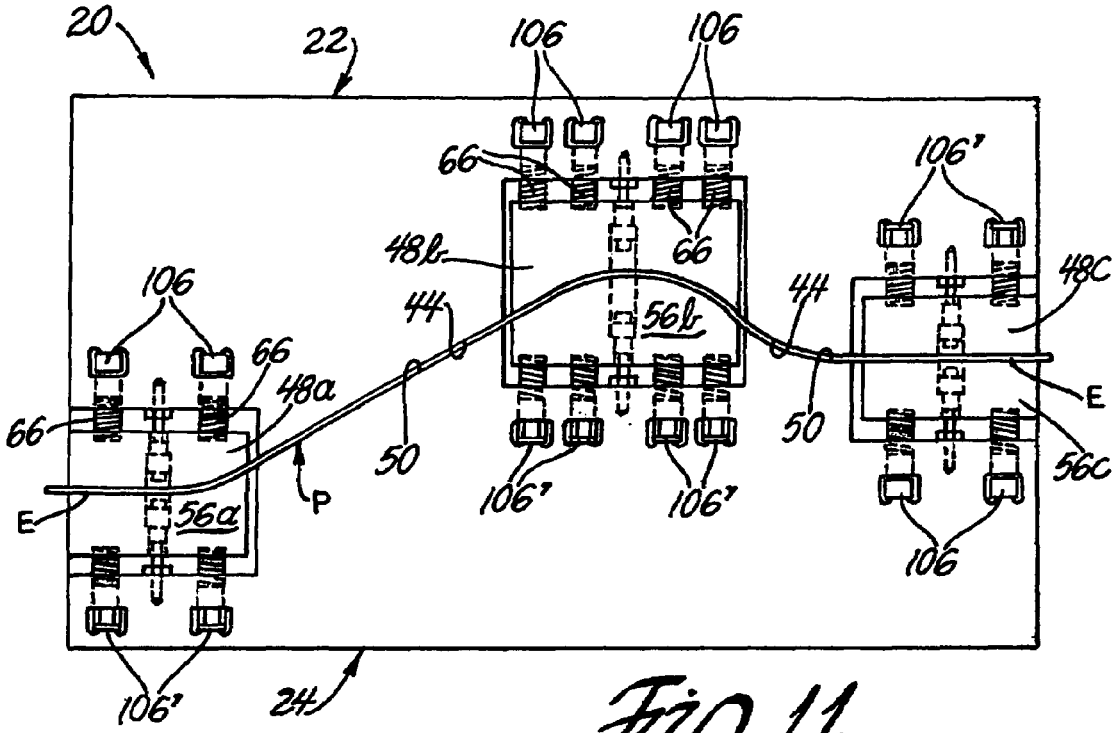
FIG. 11 illustrates an elevational view of the complementary set of forming tools of FIG. 1 taken along line 11—11, wherein the forming tools include a non-symmetrical progressive panel ejection arrangement and the tools are fully closed together with a formed panel therebetween.
Figure 12:
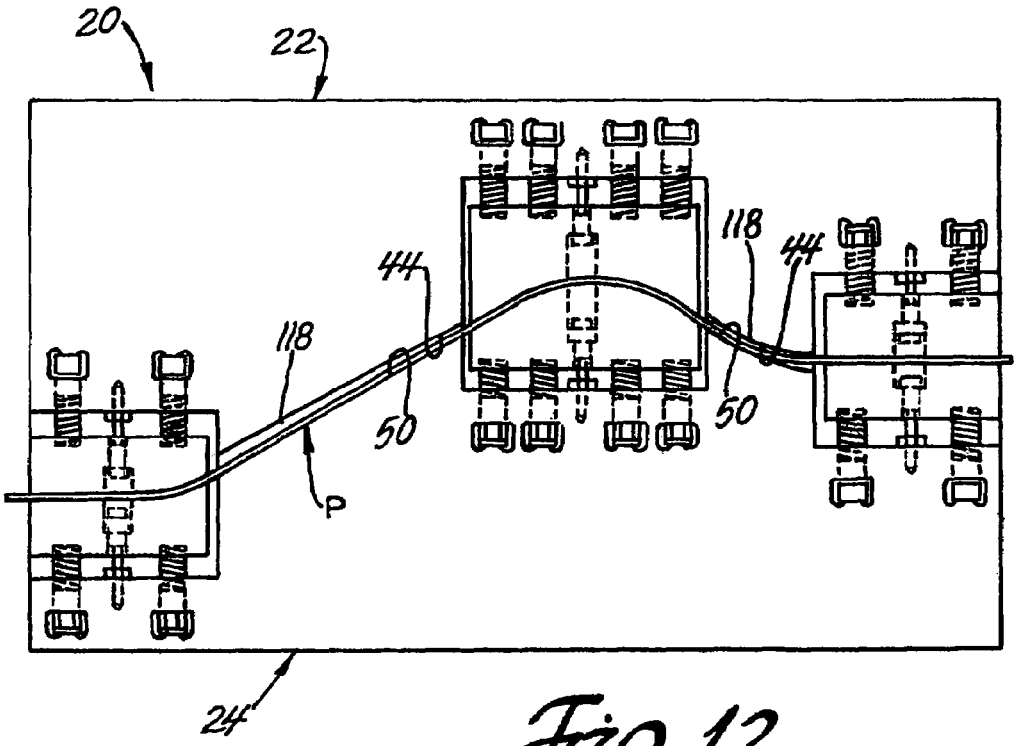
FIG. 12 illustrates an elevational view of the forming tools of FIG. 11, wherein an upper forming tool has been retracted to a first retracted position.
Figure 13:
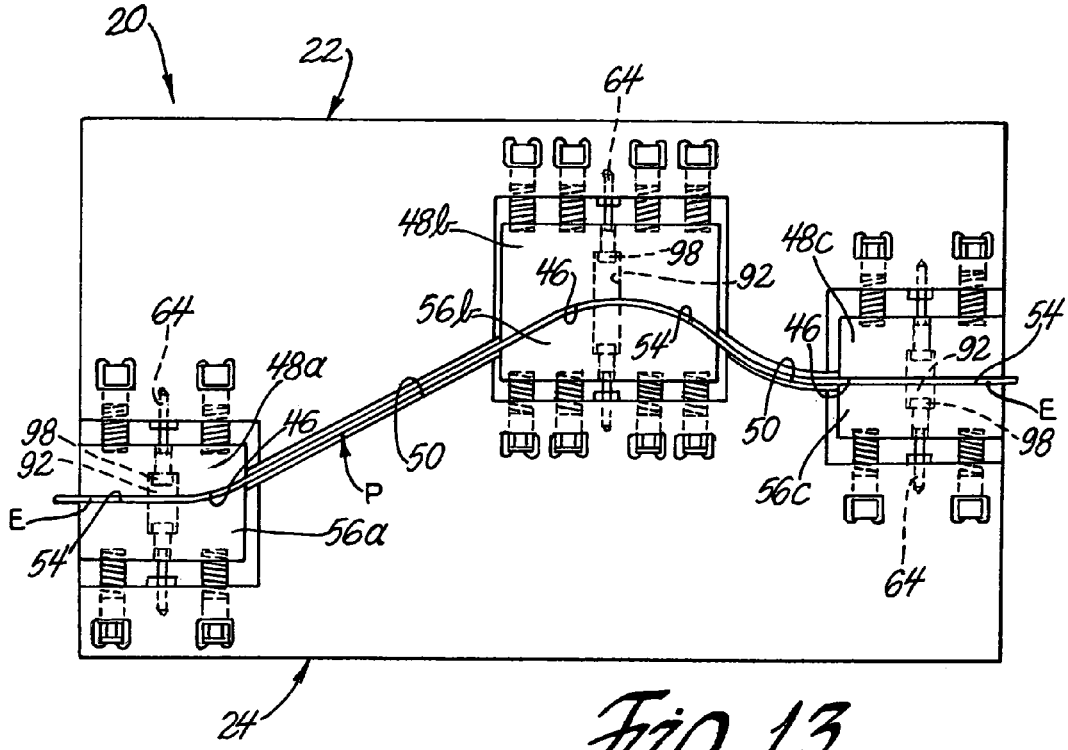
FIG. 13 illustrates an elevational view of the forming tools of FIG. 11, wherein the upper forming tool has been retracted to a second retracted position.

FIGS. 11–13 illustrate a cross-sectional view of the complementary set 20 of forming tools of FIG. 1 taken along line 11—11, wherein the upper and lower forming tools 22, 24 include a non-symmetrical progressive panel ejection arrangement and the tools 22, 24 are fully closed together with a formed panel P therebetween. As shown, there is the panel P, the upper binder surface 44 of the upper forming tool 22 and the lower binder surface 50 of the lower forming tool 24, wherein the binder surfaces 44, 50 grip a peripheral edge E of the panel P. According to the progressive panel ejection arrangement, different levels of spring pre-loads are used on laterally adjacent extractor pads 48, 56 on both of the upper and lower forming tools 22, 24. For example, the upper forming tool 22 includes a front corner extractor pad 48*a* and a center extractor pad 48*b* both having relatively larger sized shims 106 that pre-load the springs 66 to a relatively higher pre-load, while a rear corner extractor pad 48*c* has relatively smaller sized shims 106' that pre-load the springs 66 to a relatively lower resultant spring-load. It is also contemplated that the smaller sized shims 106' can be omitted altogether for a similar effect. Similarly on the lower forming tool 24 there is a front corner extractor pad 56*a* and center extractor pad 56*b* both having the smaller sized shims 106' (or none at all), while a rear corner extractor pad 56*c* has the larger sized shims 106. As such, the extractor pads 48*a*–48*c* of the upper forming tool 22 are loaded the opposite of that of the complementary extractor pads 56*a*–56*c* of the lower forming tool 24, which effect will be described below with respect to FIGS. 12 and 13.

In FIG. 12, the upper forming tool 22 is retracted to a first position by virtue of the press ram (not shown) being retracted, and a first gap 118 above the panel P develops. As the press ram and upper forming tool 22 retract, the greater spring-load (due to the greater spring pre-load) of the front corner and center extractor pads 48*a*, 48*b* of the upper forming tool 22 tend to overcome the lesser spring-load (due to the lesser spring pre-load) imposed by the corresponding or complementary extractor pads 56*a*, 56*b* of the lower forming tool 24. Accordingly, the panel P is simultaneously maintained flat against the binder surface 50 of the lower forming tool 24, while the panel P is peeled away from the binder surface 44 of the upper forming tool 22. In contrast, the greater pre-load of the rear corner extractor pad 56*c* of the lower forming tool 24 tends to overcome the pre-load spring-load imposed by the corresponding or complementary extractor pad 48*c* of the upper forming tool 22, thereby peeling a portion of the panel P away from the respective portion of the binder surface 50 of the lower forming tool 24 and maintaining the panel P against the respective portion of the binder surface 44 of the upper forming tool 22. In other words, spring-load differentials are created between respective opposing extractor pads 48*a*–48*c*, 56*a*–56*c*, wherein the spring-load differentials permit the panel to be progressively extracted from one or the other of the binder surfaces 44, 50.

In FIG. 13, the upper forming tool 22 is shown further retracted to a second position wherein the panel P has been separated from both binder surfaces 44, 50 of the upper and lower forming tools 22, 24. At this point, the extractor pads 48*a*–56*c* are all equally fully displaced to their operational extents as defined by the interference of the caps 98 of the shoulder bolts 64 with the bottoms of their respective counterbores 92. Further retraction of the upper forming tool 22 away from the lower forming tool 24 will result in the separation of the binder surfaces 46 on the upper extractor pads 48 from the panel P, thereby leaving the panel P to rest on the binder surfaces 54 of the lower extractor pads 56*a*–56*c* in a position that is slightly elevated from the rest of the binder surface 50 of the lower forming tool 24. Accordingly, the panel P can be lifted off of the extractor pads 56*a*–56*c* of the lower forming tool 24, another panel loaded, and the process repeated.

To summarize this embodiment, the extractor pads include at least two laterally adjacent extractor pads on one of the forming tools that are spring-loaded differently from one another, whereby the formed panel can be progressively separated from one of the forming tools.

Figure 14:
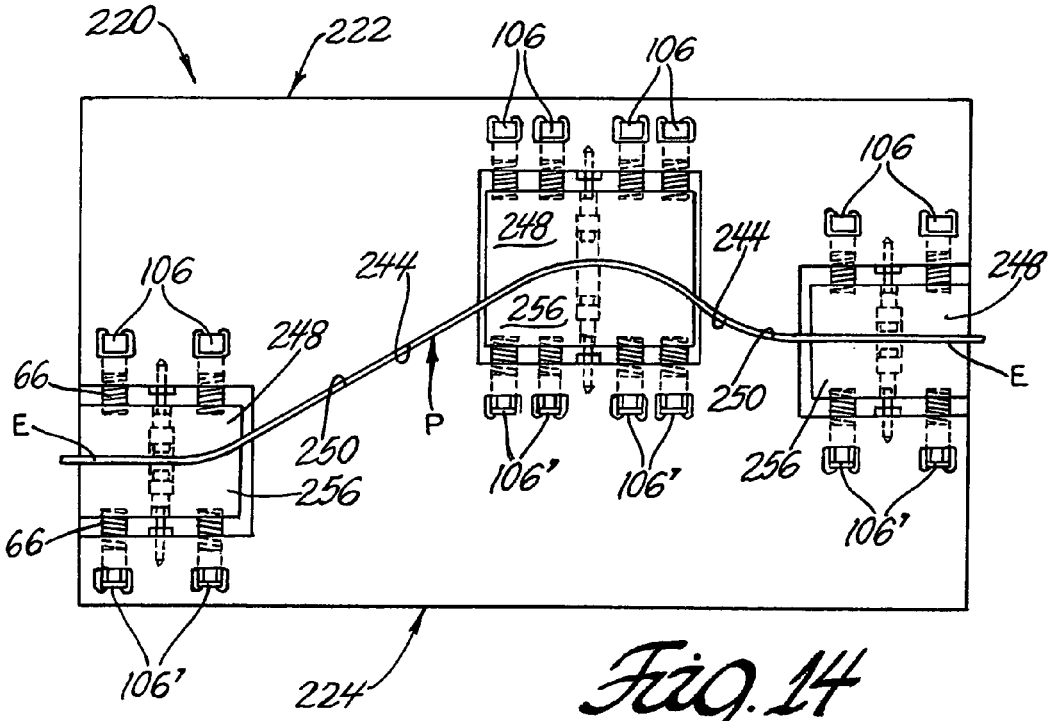
FIG. 14 illustrates an elevational view of the forming tools of FIG. 11 according to an alternative embodiment of the present invention, wherein the forming tools include a uniform panel ejection arrangement and the tools are fully closed together with a formed panel therebetween.
Figure 15:
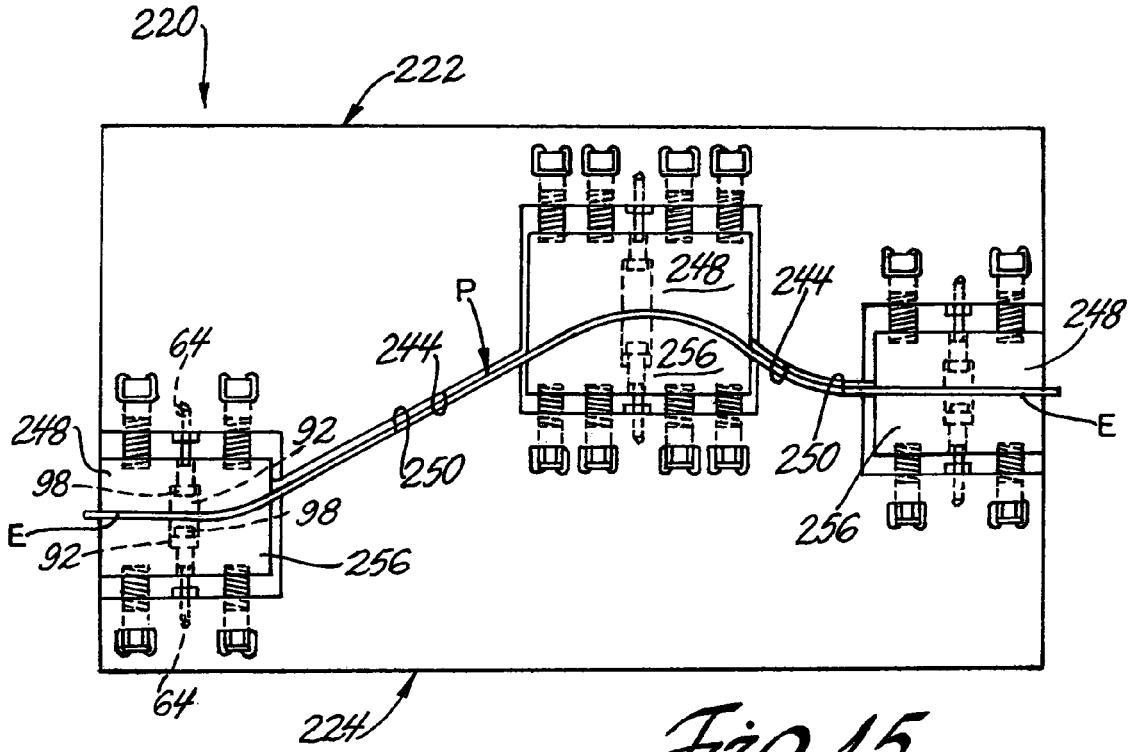
FIG. 15 illustrates an elevational view of the forming tools of FIG. 14, wherein the upper forming tool has been retracted to a second retracted position.
Figure 16:
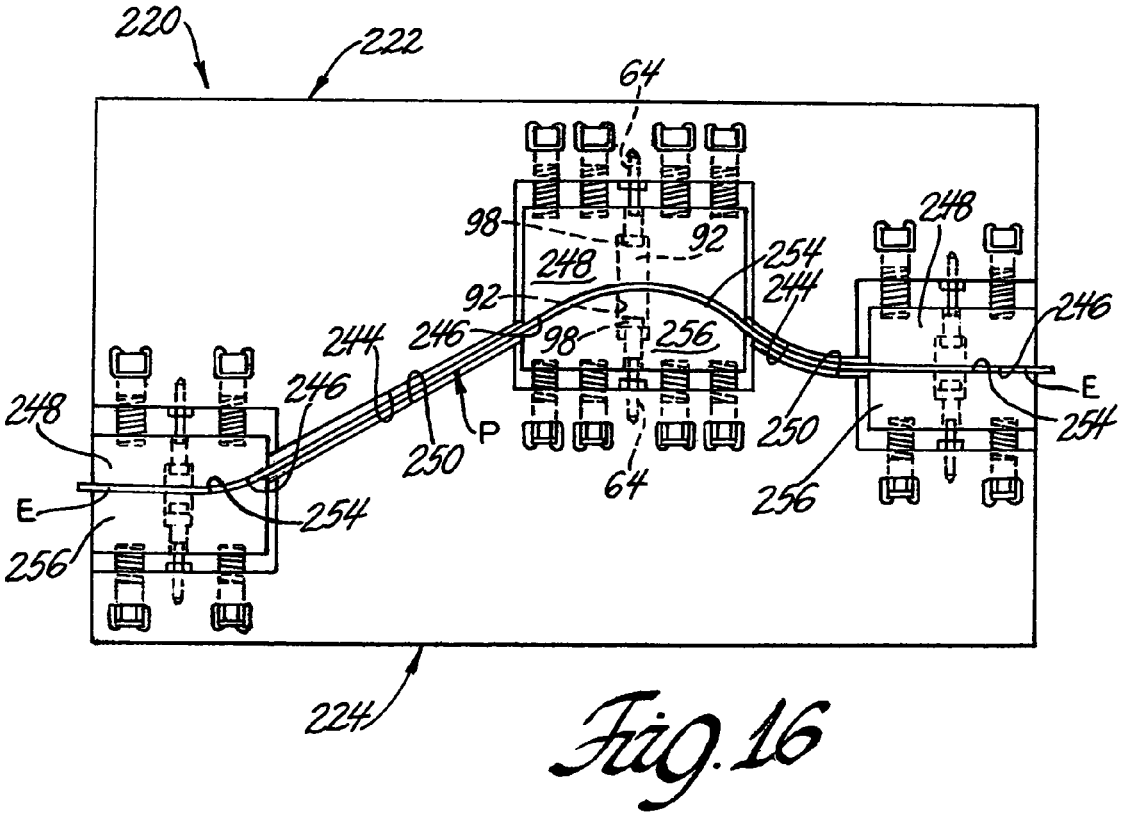
FIG. 16 illustrates an elevational view of the forming tools of FIG. 14, wherein the upper forming tool has been retracted to a second retracted position.

FIGS. 14–16 illustrate an embodiment that is alternative to that of FIGS. 11–13, wherein there is shown a cross-sectional view of complementary set 220 of upper and lower forming tools 222, 224. In FIG. 14, the forming tools 222, 224 include a uniform panel ejection arrangement and the tools 222, 224 are fully closed together with a formed panel P therebetween. As shown, there is the panel P, an upper binder surface 244 of the upper forming tool 222 and the lower binder surface 250 of the lower forming tool 224, wherein the binder surfaces 244, 250 grip a peripheral edge E of the panel P.

According to the uniform panel ejection arrangement, a first spring pre-load is used on all extractor pads 248 of the upper forming tool 222. Similarly, a second spring pre-load, different from the first spring pre-load, is used on all extractor pads 256 of the lower forming tool 224. Thus, different levels of spring pre-loads are used on respective opposed, complementary extractor pads 248, 256 of the upper and lower forming tools 222, 224. More specifically, all of the upper extractor pads 256 have larger sized shims 106 that pre-load the springs 66 to a higher pre-load. Oppositely, all of the lower extractor pads 256 have smaller sized shims 106' that establish a lower spring pre-load. The functional result of this particular structural arrangement of spring-loaded extractor pads is discussed below with reference to FIGS. 15 and 16.

In FIG. 15, the upper forming tool 222 is being retracted by virtue of the press ram of the press (not shown) being retracted. As the press ram and upper forming tool 222 are retracted, the greater resultant spring-load of all of the upper extractor pads 248 of the upper forming tool 222 tend to overcome the spring-load imposed by the corresponding complementary extractor pads 256 of the lower forming tool 224, thereby maintaining the panel P flat against the binder surface 250 of the lower forming tool 224 and uniformly extracting the panel P away from the binder surface 244 of the upper forming tool 222. Note that, in this position, the upper forming tool 222 is retracted to a particular point in which the upper extractor pads 248 are fully extended to their limits, as evident by the interference between the respective caps 98 of the respective shoulder bolts 64 and the bottom of the respective counterbored passages 92. Conversely, the lower extractor pads 256 are still fully compressed, as evident by the clearance between the respective caps 98 of the respective shoulder bolts 64 and the bottom of the respective counterbore passages 92.

In FIG. 16, the upper forming tool 222 is shown further retracted to a second position wherein the panel P has been separated from both binder surfaces 244, 250 of the upper and lower forming tools 222, 224. At this point, all of the extractor pads 248, 256 are all equally fully displaced to their operational extents as defined by the interference of the respective caps 98 of the respective shoulder bolts 64 with the bottoms of their respective counterbored passages 92. Further retraction of the upper forming tool 222 away from the lower forming tool 224 will result in the separation of the binder surfaces 246 on the upper extractor pads 248 from the panel P, thereby leaving the panel P to rest on the binder surfaces 254 of the lower extractor pads 256 in a position that is slightly elevated from the rest of the binder surface 250 of the lower forming tool 224. Accordingly, the panel P can be lifted off of the extractor pads 256 of the lower forming tool 224, another panel loaded, and the process repeated.

To summarize this embodiment, all extractor pads of one of the forming tools are spring-loaded to a first spring-load level and all extractor pads of the other of the forming tools are spring-loaded to a second spring-load level, whereby the formed panel is sequentially extracted from one of the forming tools before being extracted from the other of the forming tools. The difference between the embodiment of FIGS. 11–13 and that of FIGS. 14–16 amounts, respectively, to a difference between progressively peeling the panel away from different portions of the forming tools and uniformly separating the panel away from one forming tool and then the other forming tool in a sequential fashion. Both approaches have their advantages and the proper approach for any given panel will likely be part geometry and part material specific.

Figure 17:
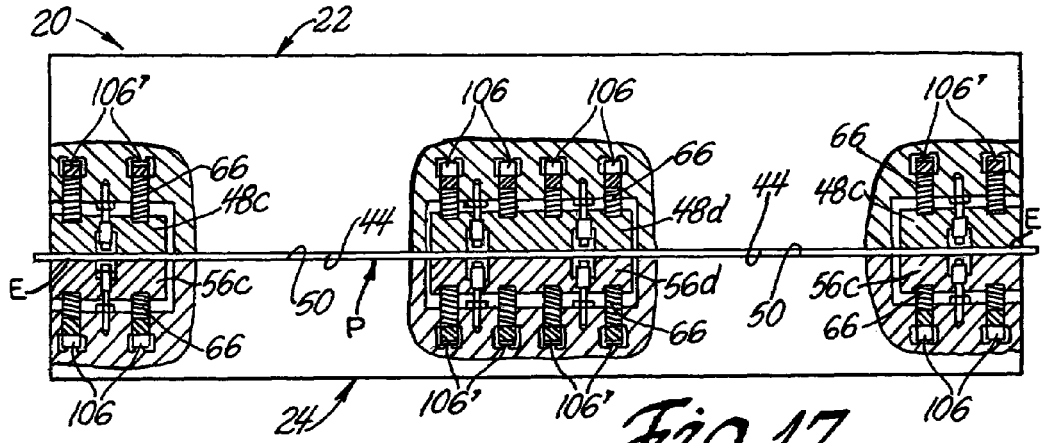
FIG. 17 illustrates a broken-out cross-sectional view of the complementary set of forming tools of FIG. 1 taken along line 17—17, according to another alternative embodiment of the present invention, wherein the forming tools include a symmetrical progressive panel ejection arrangement and the tools are fully closed together with a formed panel therebetween.
Figure 18:
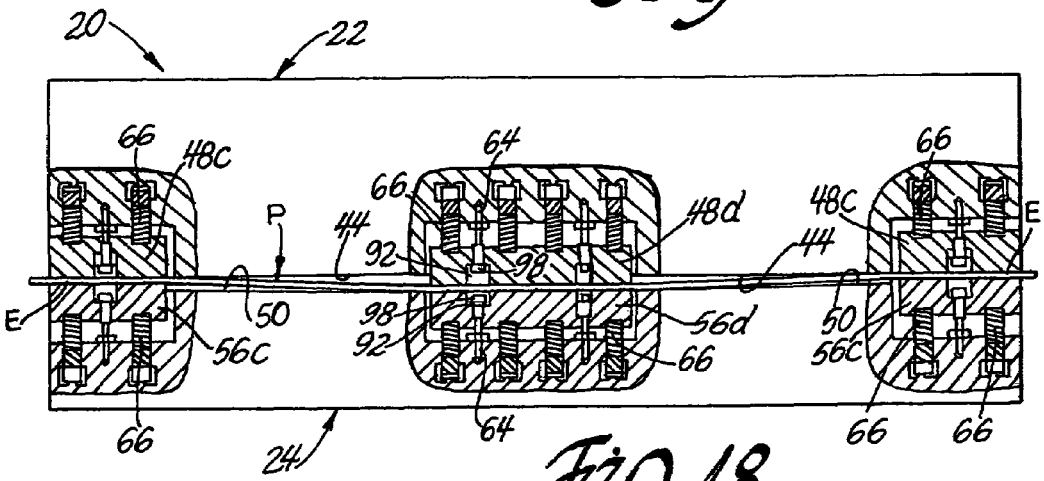
FIG. 18 illustrates a broken-out cross-sectional view of the forming tools of FIG. 17, wherein an upper forming tool has been retracted to a first retracted position.
Figure 19:
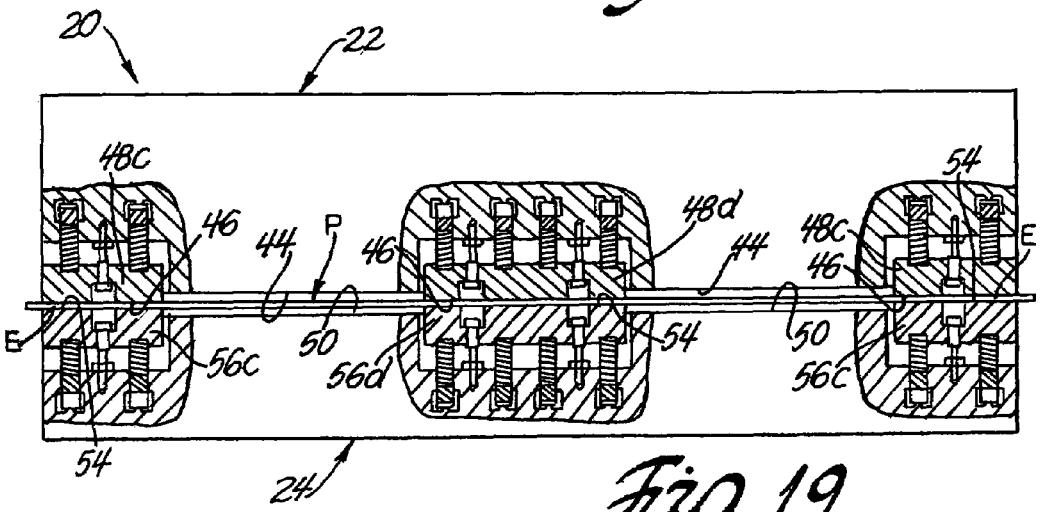
FIG. 19 illustrates a broken-out cross-sectional view of the forming tools of FIG. 17, wherein the upper forming tool has been retracted to a second retracted position.

A final alternative embodiment is depicted in FIGS. 17–19, wherein a particular panel ejection problem is addressed. FIGS. 17–19 illustrate a cross-sectional view of the complementary set 20 of forming tools of FIG. 1 taken along line 17—17, wherein the forming tools 22, 24 include a symmetrical progressive panel ejection arrangement and the tools 22, 24 are fully closed together with the formed panel P therebetween. In general, in the design of certain automotive panels it is desirable to include a cross-car crown geometry on the panel, such as for a decklid. Such a crown, however, can be difficult to precisely maintain during extraction of a hot, pliable panel from hot tooling. Sometimes, an "overcrown" condition is induced in the panel when extracting the panel from the hot forming tooling. The term overcrown refers to dimensions of the panel that are beyond a high limit of an acceptable tolerance range at a center of the crowned panel. Therefore, the present invention is well-suited to maintain crown dimensions of the panel, within tolerance, upon extraction of the panel from the hot tooling.

Specifically, in FIG. 17 the panel P is shown between the upper binder surface 44 of the upper forming tool 22 and the lower binder surface 50 of the lower forming tool 24, wherein the binder surfaces 44, 50 grip a peripheral edge E of the panel P. According to the symmetrical progressive panel ejection arrangement, different levels of spring pre-loads are used on adjacent extractor pads on both of the upper and lower forming tools 22, 24. For example, the upper forming tool 22 includes opposed corner extractor pads 48*c* on either side along a rear portion of the forming tool 22. Both extractor pads 48*c* have the smaller sized shims 106' that impose a smaller pre-load on the springs 66, while a rear center extractor pad 48*d* of the upper form tool 24 has the larger sized shims 106 that impose a higher spring pre-load. Likewise, the lower forming tool 24 includes opposed corner extractor pads 56*c* on either side along a rear portion of the forming tool 22, both having the larger sized shims 106, while a rear center extractor pad 56*d* has smaller sized shims 106'. As such, the extractor pads 48*c*, 48*d* of the upper forming tool 22 are loaded the opposite of that of the extractor pads 56*c*, 56*d* of the lower forming tool 24, which effect will be described below with respect to FIGS. 18 and 19.

In FIG. 18, the upper forming tool 22 is being retracted by virtue of the press ram of the press (not shown) being retracted and, as the press ram and upper forming tool 24 are retracted, the greater resultant spring-load of the rear center upper extractor pad 48*d* of the upper forming tool 22 tends to overcome the lesser resultant spring-load imposed by the corresponding extractor pad 56*d* of the lower forming tool 24. In other words, a spring-load differential is created therebetween to maintain the panel P flat against respective portions of the binder surface 50 of the lower forming tool 24 and to uniformly peel the panel P away from respective portions of the binder surface 44 of the upper forming tool 22. Conversely, the greater pre-load of the rear corner lower extractor pads 56*c* of the lower forming tool 24 tends to overcome the lesser pre-load spring-load imposed by the corresponding extractor pads 48*c* of the upper forming tool 22. Note that, in this position, the forming tool 22 is retracted to a particular point in which the rear center upper extractor pad 48*d* is fully extended to its limit, as evident by the interference between the respective caps 98 of the respective shoulder bolts 64 and the bottom of the respective counter-bored passages 92. Conversely, the corresponding lower extractor pad 56*d* is still fully compressed by the spring-load imposed by the upper extractor pad 48*d*, as evident by the clearance between the respective caps 98 of the respective shoulder bolts 64 and the bottom of the respective counter-bored passage 92. Likewise, the rear corner lower extractor pads 56*c* are fully extended to their limits. Conversely, the corresponding upper extractor pads 48*c* are still fully compressed by the spring-load of the corner lower extraction pads 56*c*.

In FIG. 19, the upper forming tool 22 is shown further retracted to a second position wherein the panel P has been separated from both binder surfaces 44, 50 of the upper and lower forming tools 22, 24. At this point, all of the extractor pads 48*c*, 48*d*, 56*c*, 56*d* are all equally fully displaced to their operational extents. Further retraction of the upper forming tool 22 away from the lower forming tool 24 will result in the separation of the binder surfaces 46 on the upper extractor pads 46*c*, 46*d* from the panel P, thereby leaving the panel P to rest on the binder surfaces 54 of the lower extractor pads 56*c*, 56*d* in a position that is slightly elevated from the rest of the binder surface 50 of the lower forming tool 24. Accordingly, the panel P can be lifted off of the extractor pads 56*c*, 56*d* of the lower forming tool 24, another panel loaded, and the process repeated.

The overcrown condition described previously can be further corrected for by adjusting the fully extended height limit of the center extractor pad 56*d* of the lower forming tool 24. More specifically, the height of the cap bolts 64 can be adjusted to limit the fully extended height of the extractor pad 56*d* of the lower forming tool 24 relative to the fully extended height of the other extractor pads 56*c*. Accordingly, the center extractor pad 56*d* would be disposed several millimeters below the other extractor pads 56*c*. Once the upper tool 22 has retracted away from the panel P, this arrangement would permit the hot, pliable finished panel P to sag slightly in the center at the crown of the panel, thereby inherently correcting for any overcrowning of the panel P.

To summarize this embodiment, the forming tools include at least one side and include opposed and complementary extractor pads located at laterally opposed corner positions on either side of a center position along the at least one side. The extractor pads located at the center position are spring-loaded differently from that of extractor pads located at the laterally opposed corner positions, whereby the formed panel is extracted symmetrically away from one of the forming tools at the center position and thereafter away from the other of the forming tools at the opposed corner positions. The difference between the embodiment of FIGS. 11–13 and that of FIGS. 17–19 amounts, respectively, to a difference between 1) progressively peeling a panel away from one corner along one side of one of the forming tools, and 2) symmetrically separating a panel away from one forming tool at a center thereof and thereafter separating the panel away from an opposite forming tool at opposed corners on either side of the center. Both approaches have their advantages and the proper approach for any given panel will likely be part geometry and part material specific.

In each of the above-described embodiments, the present invention provides an improved extraction apparatus having spring-loaded extractor mechanisms built into forming tools. The extractor mechanisms are adjustable by selecting different sized shims to pre-load the extractor mechanisms to different levels to strategically minimize distortion of a finished part upon removal of the part from the forming tools.

It should be understood that the invention is not limited to the embodiments that have been illustrated and described herein, but that various changes may be made without departing from the spirit and scope of the invention. For example, it is contemplated that opposed and complementary extractor pads of opposed and complementary forming tools could be pre-loaded in the same manner so as to provide a balanced or equilibrium separation of a finished panel from opposed binder surfaces. Accordingly, it is intended that the invention not be limited to the disclosed embodiments, but that it have the full scope permitted by the language of the following claims.

What is claimed is:

1. A hot blow-forming apparatus including opposed and complementary forming tools adapted for hot blow forming at least one of a first and second surface of a heated sheet-metal workpiece against at least one forming surface of at least one of said forming tools to produce a formed part, said forming tools being adapted to close upon and grip a peripheral edge of said workpiece and perform work on a central portion of said workpiece to define said formed part, said tools including opposed and complementary extractor pads that are spring-loaded to different levels in different locations of said forming tools to minimize distortion of said formed part upon extraction of said formed part from said forming tools.

2. The apparatus of claim 1 wherein said extractor pads include at least two laterally adjacent extractor pads on one of said forming tools that are spring-loaded differently from one another, whereby said formed part can be progressively separated from said one of said forming tools.

3. The apparatus of claim 1 wherein all extractor pads of one of said forming tools are spring-loaded to a first spring-load level and all extractor pads of the other of said forming tools are spring-loaded to a second spring-load level, whereby said formed part is sequentially extracted from one of said forming tools before being extracted from the other of said forming tools.

4. The apparatus of claim 1 wherein said forming tools include at least one side, and said forming tools further include opposed and complementary extractor pads located at laterally opposed corner positions on either side of a center position along said at least one side of said forming tools, wherein said extractor pads located at said center position are spring-loaded differently from that of said extractor pads located at said laterally opposed corner positions, whereby said formed part is extracted away from one of said forming tools at said center position and thereafter away from the other of said forming tools at said opposed corner positions.

5. An apparatus for hot blow forming of a heated sheet, said heated sheet having first and second surfaces and a peripheral edge, said apparatus being adapted to close upon and grip said peripheral edge of said heated sheet, said apparatus comprising:

a first forming tool including a first forming surface and a first binder surface circumscribing said first forming surface for sealingly engaging said first surface of said heated sheet at said peripheral edge thereof, said first forming tool further including a first plurality of spring-loaded extractor mechanisms positioned outboard of said first forming surface, said first plurality of spring-loaded extractor mechanisms having individual binder surfaces partially defining said first binder surface; and a second forming tool opposed to and complementary with said first forming tool, said second forming tool including a second forming surface and a second binder surface circumscribing said second forming surface for sealingly engaging said second surface of said heated sheet at said peripheral edge thereof, said second forming tool further including a second plurality of spring-loaded extractor mechanisms positioned outboard of said second forming surface, said second plurality of spring-loaded extractor mechanisms having individual binder surfaces partially defining said second binder surface, said second plurality of spring-loaded extractor mechanisms being substantially opposed to and complementary with said first plurality of spring-loaded extractor mechanisms, at least one of said second plurality of spring-loaded extractor mechanisms having a different spring-load from that of a respective complementary spring-loaded extractor mechanism of said first plurality of spring-loaded extractor mechanisms thereby establishing a spring-load differential therebetween, whereby at least a portion of said heated sheet is relatively biased against one or the other of said at least one of said second plurality of spring-loaded extractor mechanisms and said complementary spring-loaded extractor mechanism of said first plurality of spring-loaded extractor mechanisms.

6. The apparatus of claim 5, wherein said first plurality of spring-loaded extractor mechanisms includes at least one spring-loaded extractor mechanism having a different spring pre-load than a laterally adjacent spring-loaded extractor mechanism of said first forming tool.

7. The apparatus of claim 6, wherein said second plurality of spring-loaded extractor mechanisms includes at least one spring-loaded extractor mechanism having a different spring pre-load than a laterally adjacent spring-loaded extractor mechanism of said second forming tool.

8. The apparatus of claim 5, wherein all of said first plurality of spring-loaded extractor mechanisms are pre-loaded to a first pre-load level and all of said second plurality of spring-loaded extractor mechanisms are pre-loaded to a second pre-load level, whereby said heated sheet is sequentially extracted from one of said forming tools before being extracted from the other of said forming tools.

9. The apparatus of claim 5 wherein each of said forming tools includes at least one side and further include extractor pads located at laterally opposed corner positions on either side of a center position along said at least one side, wherein said extractor pads located at said center position are spring-loaded differently from that of said extractor pads located at said laterally opposed corner positions, whereby a formed part is extractable away from one of said forming tools at said center position and thereafter away from the other of said forming tools at said opposed corner positions.

10. An extractor mechanism for use with a forming tool assembly for hot blow-forming a part from a blank of sheet-metal, said forming tool assembly including a forming tool body having a working surface, a rear surface disposed substantially oppositely of said working surface, and at least one sidewall extending therebetween, said forming tool body having at least one extractor pocket in said working surface and at least one access pocket in said at least one sidewall, said working surface having at least one spring bore in a surface of said extractor pocket in open communication with said at least one access pocket, said extractor mechanism being adapted for attachment to said forming tool body and comprising:

an extractor pad adapted for positioning within said at least one extractor pocket in said working surface of said forming tool body and having a binder surface and an oppositely disposed rear surface, said extractor pad also having a throughbore extending between said binder surface and said rear surface and a counterbore in said binder surface in communication with said throughbore, said extractor pad further having a recess provided in said rear surface;

a fastener having a shank portion extending through said throughbore of said extractor pad and being adapted for fastening to said forming tool body, said fastener further having a cap within said counterbore of said extractor pad wherein said cap limits travel of said extractor pad away from said forming tool body;

a spring backup assembly adapted for positioning at least partially within said spring bore of said forming tool body; and a spring adapted for positioning within said spring bore of said forming tool body between said spring backup assembly and said extractor pad, said spring having a forward end registered within said recess of said extractor pad and a rear end in abutment with said spring backup assembly.

11. The extractor mechanism of claim 10 further comprising a shim adapted for insertion into said at least one access pocket.

12. The extractor mechanism of claim 11 further comprising a wedge tool adapted for insertion into said at least one access pocket for displacing said spring backup assembly and providing clearance for insertion of said shim.

* * * * *